US012449179B2

(12) United States Patent
Devos et al.

(10) Patent No.: US 12,449,179 B2
(45) Date of Patent: Oct. 21, 2025

(54) SYSTEMS AND METHODS FOR CLEAR ICE MAKING IN APPLIANCES

(71) Applicant: Haier US Appliance Solutions, Inc., Wilmington, DE (US)

(72) Inventors: Richard Devos, Goshen, KY (US); Brent Alden Junge, Louisville, KY (US); Kirk Waiz, Louisville, KY (US); Dong Huang, Zhangjiagang (CN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/923,753

(22) PCT Filed: Oct. 11, 2022

(86) PCT No.: PCT/CN2022/124574
§ 371 (c)(1),
(2) Date: Nov. 7, 2022

(87) PCT Pub. No.: WO2024/077472
PCT Pub. Date: Apr. 18, 2024

(65) Prior Publication Data
US 2024/0271847 A1 Aug. 15, 2024

(51) Int. Cl.
*F25C 5/10* (2006.01)
*F25C 1/18* (2006.01)

(52) U.S. Cl.
CPC . *F25C 5/10* (2013.01); *F25C 1/18* (2013.01)

(58) Field of Classification Search
CPC ..... F25C 1/18; F25C 5/10; F25B 2600/0251; F25B 2400/0403
See application file for complete search history.

(56) References Cited

U.S. PATENT DOCUMENTS 3,276,221 A * 10/1966 Crumley ..... F25B 49/025 62/505
3,779,029 A 12/1973 Larriva
(Continued)

FOREIGN PATENT DOCUMENTS

CN 1257988 A 6/2000
CN 1276231 C 9/2006
(Continued)

OTHER PUBLICATIONS

Translation JP2013083359 (Year: 2013).*
(Continued)

*Primary Examiner* — Joseph F Trpisovsky
(74) *Attorney, Agent, or Firm* — Dority & Manning, P.A.

(57) ABSTRACT

An ice making appliance includes an ice mold and a refrigeration system. The refrigeration system includes a pump that is in fluid connection with a water supply and a compressor that is in fluid communication with a bypass valve. The compressor is one of a low back-pressure compressor and a medium back-pressure compressor. A condenser and an evaporator are in fluid communication with the bypass valve. The evaporator is positioned proximate the ice mold. The pump is operable to flow liquid from the water supply over the evaporator. The compressor is configured to turn off during an ice harvesting period, after the ice harvesting period, or both.

17 Claims, 8 Drawing Sheets

(56) References Cited

U.S. PATENT DOCUMENTS

| | | | | |
|---|---|---|---|---|
| 4,412,429 | A | 11/1983 | Kohl | |
| 6,000,228 | A | 12/1999 | Johnson et al. | |
| 6,612,118 | B2 | 9/2003 | Billman et al. | |
| 2007/0089451 | A1 | 4/2007 | Lee | |
| 2007/0157636 | A1* | 7/2007 | Billman | F25C 1/12 62/73 |
| 2014/0144175 | A1 | 5/2014 | Broadbent | |
| 2016/0327352 | A1* | 11/2016 | Broadbent | F25C 5/182 |

FOREIGN PATENT DOCUMENTS

| | | | |
|---|---|---|---|
| CN | 1880890 | A | 12/2006 |
| CN | 107504735 | A | 12/2017 |
| CN | 108072216 | A | 5/2018 |
| CN | 112240658 | A | 1/2021 |
| JP | H0545032 | A | 2/1993 |
| JP | H10148439 | A | 6/1998 |
| JP | 2003336948 | A | 11/2003 |
| JP | 2007100988 | A | 4/2007 |
| JP | 2013083359 | A | 5/2013 |
| WO | WO2007099143 | A2 | 9/2007 |

OTHER PUBLICATIONS

Translation JPH 10148439A (Year: 1998).*
International Search Report Corresponding to Application No. PCT/CN2022/124574 on Jun. 12, 2023.

* cited by examiner

SYSTEMS AND METHODS FOR CLEAR ICE MAKING IN APPLIANCES

CROSS-REFERENCE TO RELATED APPLICATIONS

The present application is the National Stage Entry of and claims the benefit of priority under 35 U.S.C. § 371 to PCT Application Serial No. PCT/CN2022/124574 filed Oct. 11, 2022 and entitled SYSTEMS AND METHODS FOR CLEAR ICE MAKING IN APPLIANCES, which is hereby incorporated by reference in its entirety.

FIELD OF THE INVENTION

The present subject matter relates generally to systems for clear ice makers in appliances.

BACKGROUND OF THE INVENTION

Appliances with ice makers are generally plumbed to a water supply, and water from the water supply flows to the ice maker. Within the ice maker, the water is frozen to form ice. The ice makers are frequently cooled by a sealed system, and heat transfer between liquid water in the ice maker and refrigerant of the sealed system generates the ice. Current clear icemakers require a compressor capable of withstanding high back-pressure during the ice making process.

Certain consumers find clear ice preferable to cloudy ice. In clear ice formation processes, dissolved solids typically found within water, e.g., tap water, are separated out and essentially pure water freezes to form the clear ice. Since the water in clear ice is purer than that found in typical cloudy ice, clear ice is less likely to affect drink flavors.

BRIEF DESCRIPTION OF THE INVENTION

Aspects and advantages of the invention will be set forth in part in the following description, or may be apparent from the description, or may be learned through practice of the invention.

In one example embodiment, an ice making appliance includes an ice mold and a refrigeration system. The refrigeration system includes a pump that is in fluid connection with a water supply and a compressor that is in fluid communication with a bypass valve. The compressor is one of a low back-pressure compressor or a medium back-pressure compressor. A condenser and an evaporator are in fluid communication with the bypass valve. The evaporator is positioned proximate the ice mold. The pump is operable to flow liquid from the water supply over the evaporator. The compressor is configured to turn off during an ice harvesting period, after the ice harvesting period, or both.

In another example embodiment, an ice making appliance includes an ice mold and a refrigeration system. The refrigeration system includes a pump that is in fluid connection with a water reservoir and a compressor that is in fluid communication with a bypass valve. The compressor is one of a low back-pressure compressor or a medium back-pressure compressor. A condenser and an evaporator are in fluid communication with the bypass valve. The evaporator is positioned proximate the ice mold. The compressor is configured to turn off during an ice harvesting period, after the ice harvesting period, or both. The pump is configured to pump water from the reservoir over the evaporator during and after the ice harvesting period.

In another example embodiment, a method of operation an ice making appliance. The ice making appliance includes one of a low back-pressure compressor or a medium back-pressure compressor, an ice mold, and a pump in fluid connection with a water supply. The method includes compressing, with the one of the low back-pressure compressor or the medium back-pressure compressor, a refrigerant. Condensing, by a condenser, the refrigerant. Heating, by an evaporator, the refrigerant. The evaporator is positioned proximate the ice mold such that the refrigerant draws heat from water in the ice mold. Pumping, by the pump, water from the water supply over the evaporator. Releasing, from the one of the low back-pressure compressor or the medium back-pressure compressor, hot refrigerant through a bypass valve to the evaporator. The one of the low back-pressure compressor or the medium back-pressure compressor is off when the hot refrigerant is released. Harvesting, from the ice mold, ice.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
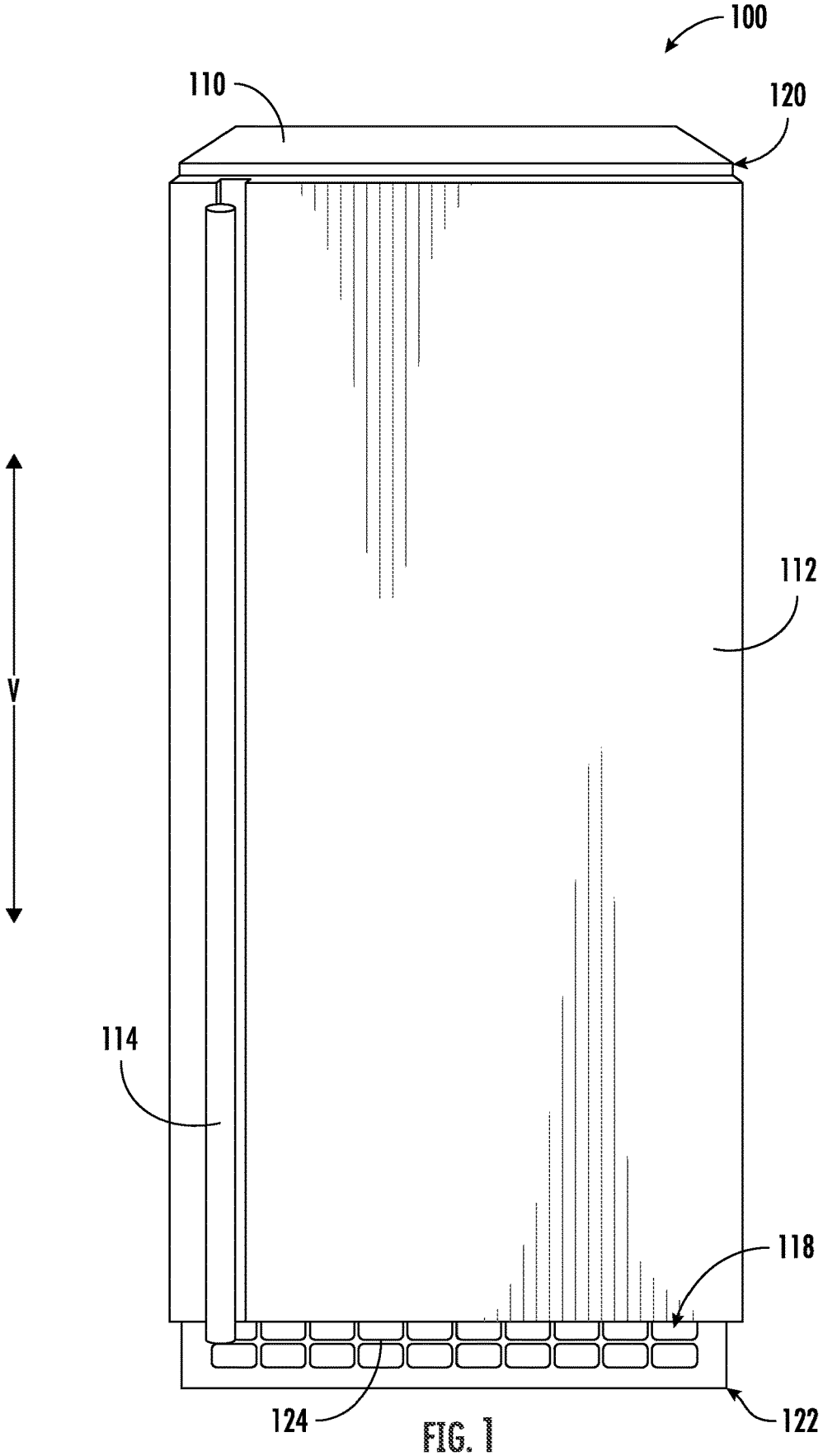
FIG. 1 is a front view of an ice making appliance according to an example embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
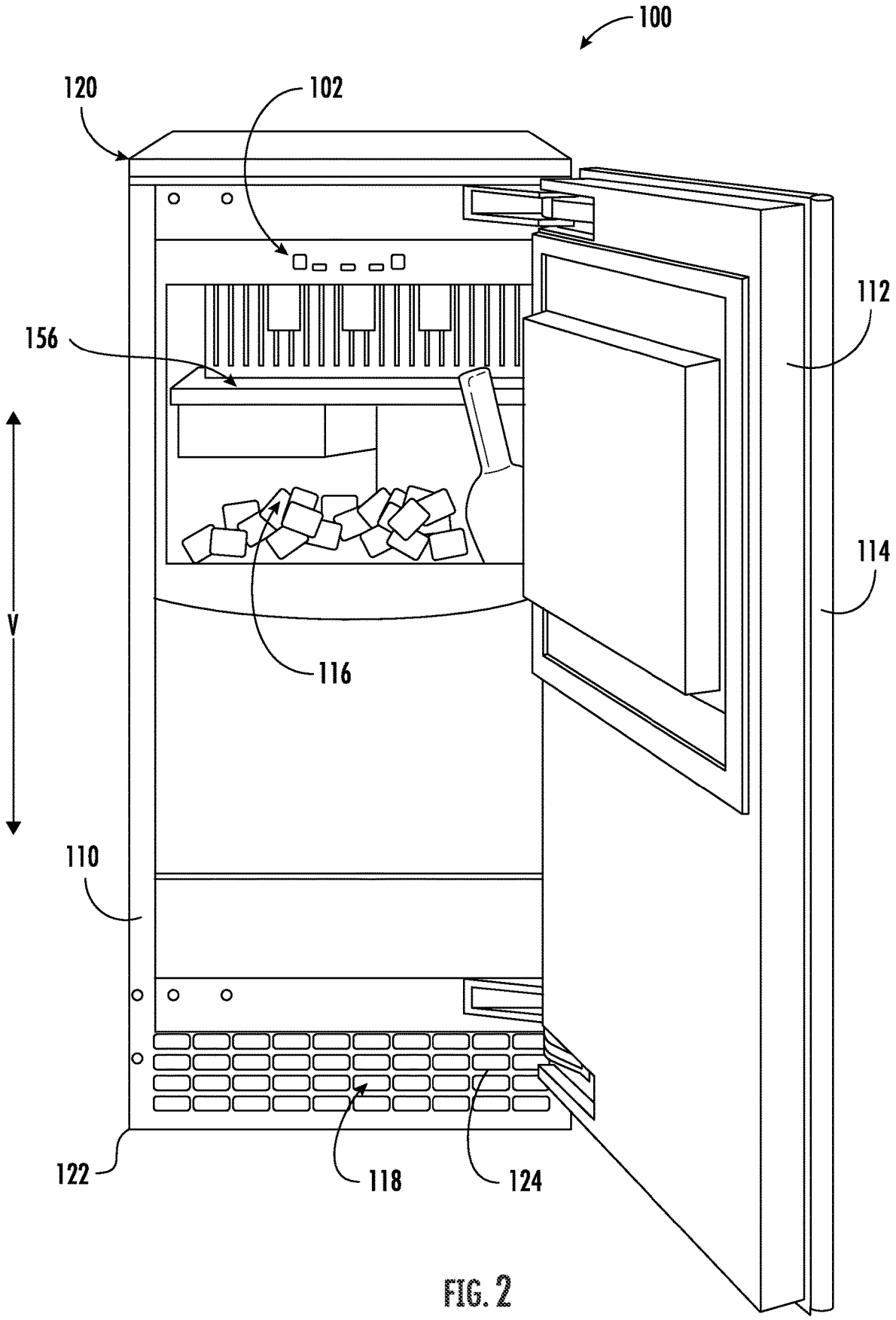
FIG. 2 is a front view of the example ice making appliance of FIG. 1 with the door shown in an open configuration.
Figure 3:
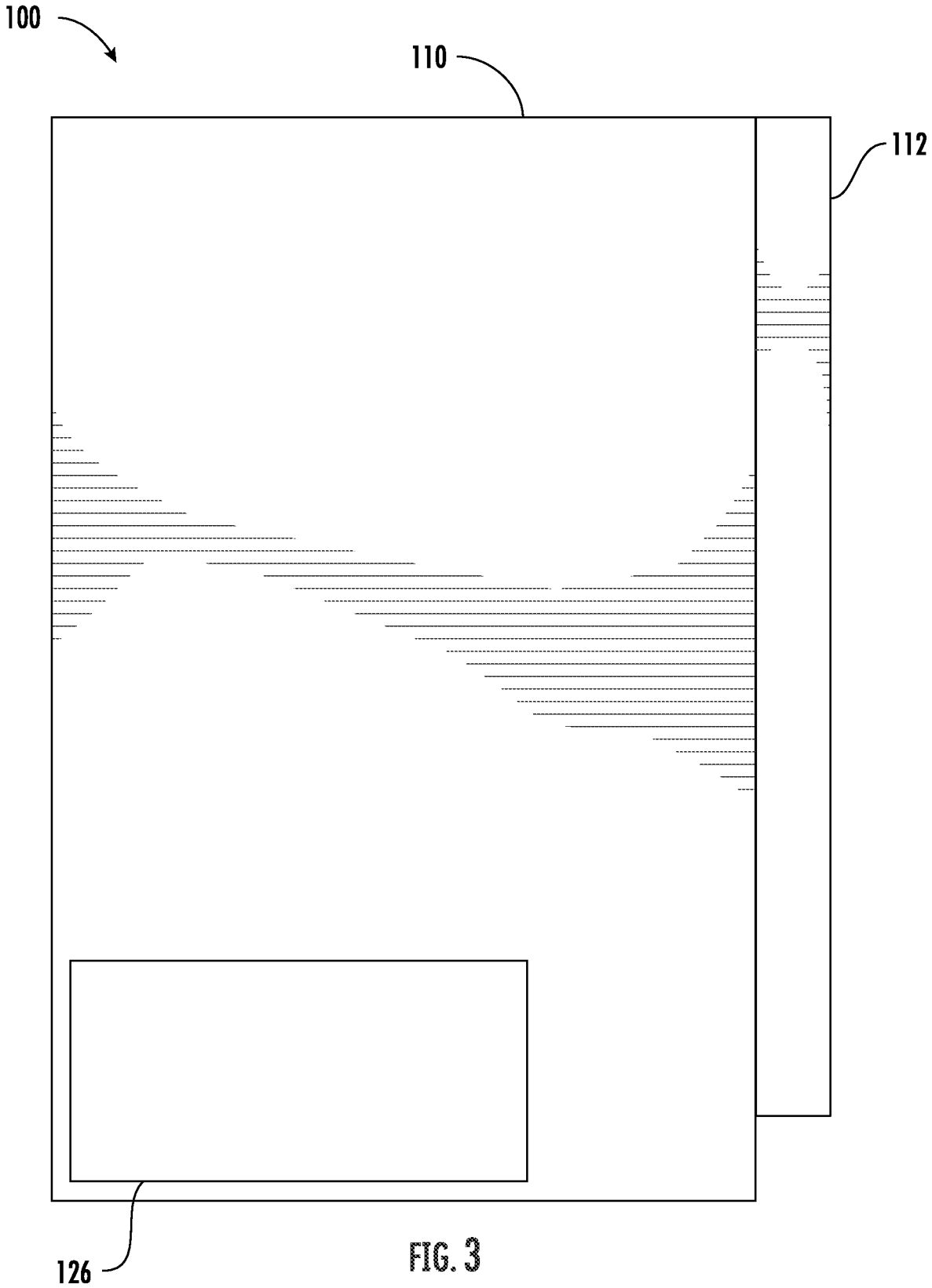
FIG. 3 is a side view of the example ice making appliance of FIG. 1 with a panel removed exposing a portion of the refrigeration system.

FIGS. 1 through 3 provide perspective views of an ice making appliance 100 according to an example embodiment of the present subject matter. As shown in FIGS. 1 and 2, ice making appliance 100 may include a cabinet 110 and a door 112. In FIG. 1, a door 112 of ice making appliance 100 is shown in a closed position. Door 112 of ice making appliance 100 is shown in an open position in FIG. 2. Door 112 may be rotatably hinged to cabinet 110 such that a user may pull on a handle 114 of door 112 (or directly on door 112) to adjust door 112 between the open and closed positions. In the closed position, door 112 may block access to and assist with sealing an ice storage chamber 116 within cabinet 110. The user may rotate door 112 to the open position to access ice storage chamber 116 and ice stored therein.

Cabinet 110 may extend between a top portion 120 and a bottom portion 122, e.g., along a vertical direction V. Ice storage chamber 116 may be positioned at or proximate top portion 120 of cabinet 110. A machinery compartment 118 may be positioned within cabinet 110, e.g., at or adjacent bottom portion 122 of cabinet 110. Cabinet 110 may include insulation (not shown) between ice storage chamber 116 and machinery compartment 118 in order to limit heat transfer between ice storage chamber 116 and machinery compartment 118 through cabinet 110. A grill 124 at bottom portion 122 of cabinet 110 may permit air flow between machinery compartment 118 and ambient air about cabinet 110. As shown in FIG. 3, a side view of cabinet 110 of ice making appliance 100, cabinet 110 may have an access panel 126 to provide additional access to machinery compartment 118, e.g., for maintenance.

While described in greater detail below in the context of ice making appliance 100, it will be understood that the present subject matter may be used in or within any suitable appliance in alternative exemplary embodiments. For example, the present subject matter may be used in or with ice making appliances having other arrangements or components than that shown in FIGS. 1 and 2. As another example, the present subject matter may be used in or with refrigerator appliances or freezer appliances in alternative exemplary embodiments. Thus, it will be understood that the present subject matter is not limited to use in freestanding ice making appliances.

Figure 4:
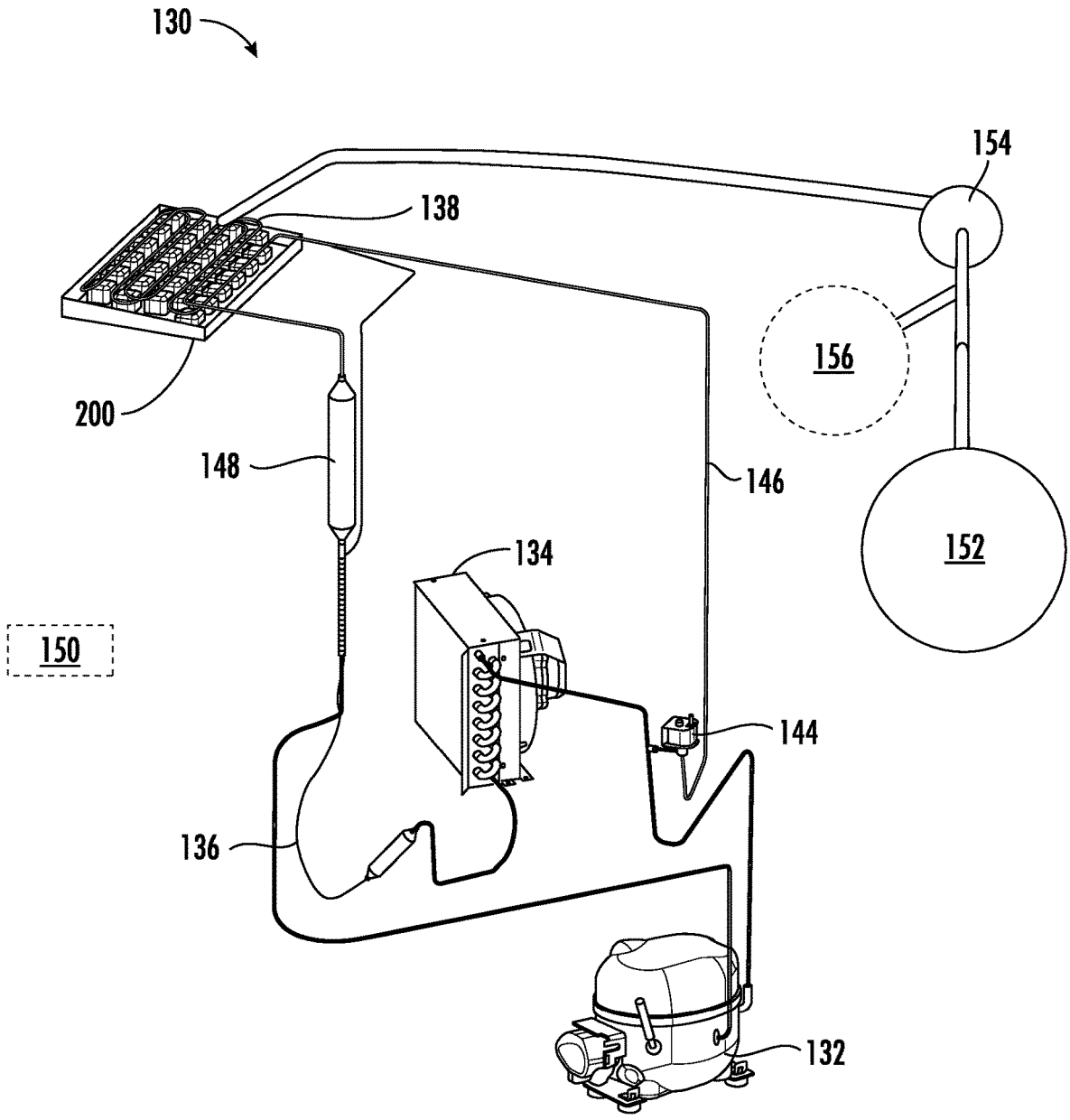
FIG. 4 is a schematic of an example embodiment of a refrigeration system of the example ice making appliance of FIG. 1.

FIG. 4 provides a schematic view of certain components of ice making appliance 100, including a sealed refrigeration system 130 that may execute a vapor-compression cycle and an ice maker 200. Machinery compartment 118 may include some components of sealed refrigeration system 130, and ice maker 200 may be positioned at or adjacent ice storage chamber 116. Sealed refrigeration system 130 may include a compressor 132, a condenser 134, a throttling or expansion device 136, and an evaporator 138 connected in series and charged with a refrigerant. Compressor 132, condenser 134 and/or expansion device may be positioned at or within machinery compartment 118 while evaporator 138 may be positioned at or adjacent ice storage chamber 116.

In certain example embodiments, compressor 132 may be configured as one of a low back-pressure compressor and a medium back-pressure compressor. The terms "low back-pressure", "medium back-pressure", and "high back-pressure" are widely used in the art to describe compressor designs and are used herein the conventional manner as will be understood by one of ordinary skill in the art. Thus, e.g.: a low back-pressure compressor may be configured to for relatively low evaporation temperatures, such as from negative ten degrees Celsius (−10° C.) to negative thirty-five degrees Celsius (−35° C.) or to negative forty-five degrees Celsius (−45° C.), and be suitable for use in freezers and refrigerators with freezer compartments; a medium back-pressure compressor may be configured to for relatively moderate evaporation temperatures, such as from negative twenty degrees Celsius (−20° C.) to zero degrees Celsius (0° C.), and be suitable for use in cold cabinets, milk coolers, ice machines, and water coolers; and a high back-pressure compressor may be configured to for relatively high evaporation temperatures, such as from negative five degrees Celsius (−5° C.) to fifteen degrees Celsius (15° C.), and be suitable for use in dehumidifiers and liquid coolers. Conventionally, high back-pressure compressors have been used in ice maker appliances to withstand high back-pressure even though the back-pressure is low or medium for a substantially portion (e.g., 90%) of the ice making cycle. However, compressor 132 may be a low back-pressure compressor or a medium back-pressure compressor, and ice making appliance 100 may be configured operate with the low or medium back-pressure compressor.

Within refrigeration system 130, refrigerant may flow into compressor 132, operating to increase the pressure of the refrigerant. This compression of the refrigerant raises the refrigerant's temperature, thus then lowering by passing the refrigerant through condenser 134. Within condenser 134, heat may exchange with the ambient air so as to cool the refrigerant. A condenser fan (not shown) may be used to pull air across condenser 134 so as to provide forced convection for a more rapid and efficient heat exchange between the refrigerant within condenser 134 and the ambient air. Thus, as will be understood by those skilled in the art, increasing air flow across condenser 134 may, e.g., increase the efficiency of condenser 134 by improving cooling of the refrigerant contained therein.

The expansion device (e.g., a valve, capillary tube, or other throttling device) 136 may receive refrigerant from condenser 134. From expansion device 136, the refrigerant may enter evaporator 138. Upon exiting expansion device 136 and entering evaporator 138, the refrigerant may drop in pressure, i.e., the expansion of refrigerant drawing heat energy from the surroundings. Due to the pressure drop and/or phase change of the refrigerant, evaporator 138 may be cool relative to liquid water within the proximate ice maker 200. As such, evaporator 138 directly and/or indirectly refrigerates ice maker 200 in order to freeze liquid water within ice maker 200 and form ice therein. As an example, evaporator 138 may be a type of heat exchanger that is mounted to or formed within ice maker 200 to directly cool ice maker 200. As another example, evaporator 138 may be a type of heat exchanger which transfers heat from air passing over evaporator 138 to refrigerant flowing through evaporator 138 and the chilled air from evaporator 138 may be flowed to ice maker 200 in order to indirectly cool ice maker 200 with the chilled air from evaporator 138. An evaporator fan (not shown) may be used to pull air across evaporator 138 and circulate air across or to ice maker 200.

Collectively, the vapor compression cycle components in a refrigeration circuit, associated fans, and associated compartments are sometimes referred to as a sealed refrigeration system. The refrigeration system 130 depicted in FIG. 4 is provided by way of example only. Thus, it is within the scope of the present subject matter for other configurations of the refrigeration system to be used as well. It will be understood that refrigeration system 130 may include additional components, e.g., at least one additional evaporator, compressor, expansion device, and/or condenser. As an example, refrigeration system 130 may include two evaporators.

Bypass valve 144 may be disposed downstream of compressor 132, e.g., and upstream of condenser 134 and/or expansion device 136. Thus, refrigerant from compressor 132 flows to bypass valve 144 within refrigeration system 130 during operation of compressor 132. As an example, bypass valve 144 may be a two-way valve, such as a two-way solenoid valve. As another example, bypass valve 144 may be a three-way valve, such as a three-way solenoid valve. Bypass conduit 146 fluidly couples bypass valve 144 and evaporator 138 such that refrigerant at bypass valve 144 may flow through bypass conduit 146 to evaporator 138, e.g., around condenser 134 and/or expansion device 136. As an example, bypass conduit 146 may be (e.g., aluminum or copper) tubing or piping that extends from bypass valve 144 to an inlet of evaporator 138. Thus, bypass valve 144 and evaporator 138 may be in direct fluid communication with each other via bypass conduit 146.

Bypass valve 144 may be selectively adjustable, e.g., by controller 150, between a normal operating configuration and a harvest or bypass operating configuration. In the normal operating configuration, bypass valve 144 may be closed such that refrigerant from compressor 132 flows through condenser 134 to expansion device 136 and evaporator 138 during operation of compressor 132. Thus, refrigerant flows through refrigeration system 130 in the manner described above with reference to FIG. 3 when bypass valve 144 is in the normal operating configuration such that refrigeration system 130 operates to cool ice maker 200 with evaporator 138. Conversely, refrigerant from compressor 132 flows through bypass valve 144 to evaporator 138 during operation of compressor 132 in the bypass operating configuration. Thus, refrigerant from compressor 132 bypasses condenser 134 and/or expansion device 136 in the bypass operating configuration such that refrigeration system 130 does not operate to cool ice maker 200. By actuating from the normal operating configuration to the bypass operating configuration, bypass valve 144 may assist with implementing a harvest cycle of refrigeration system 130.

Refrigerant at an inlet of evaporator 138 may be hotter when bypass valve 144 is in the bypass operating configuration compared to when bypass valve 144 is in the normal operating configuration. Thus, refrigerant delivered to evaporator 138 via bypass conduit 146 may flow into evaporator 138 and heat evaporator 138 after shifting bypass valve 144 from normal operating configuration to the bypass operating configuration. By heating evaporator 138, the refrigerant within evaporator 138 melts ice on ice maker 200 and thereby harvests the ice. Thus, bypass valve 144 and bypass conduit 146 may assist with harvesting ice from ice maker 200 by bypassing refrigerant flow around condenser 134 and/or expansion device 136 and delivering refrigerant that is hotter than the freezing temperature of water into evaporator 138. As an example, when bypass valve 144 is in the bypass operating configuration, refrigerant entering evaporator 138 from bypass conduit 146 may have a temperature no less than sixty degrees Celsius (60° C.). An accumulator 148 may be in fluid communication with compressor 132. Accumulator 148 may prevent liquid slugging of the compressor and refrigerant dilution of compressor oil.

Figure 5:
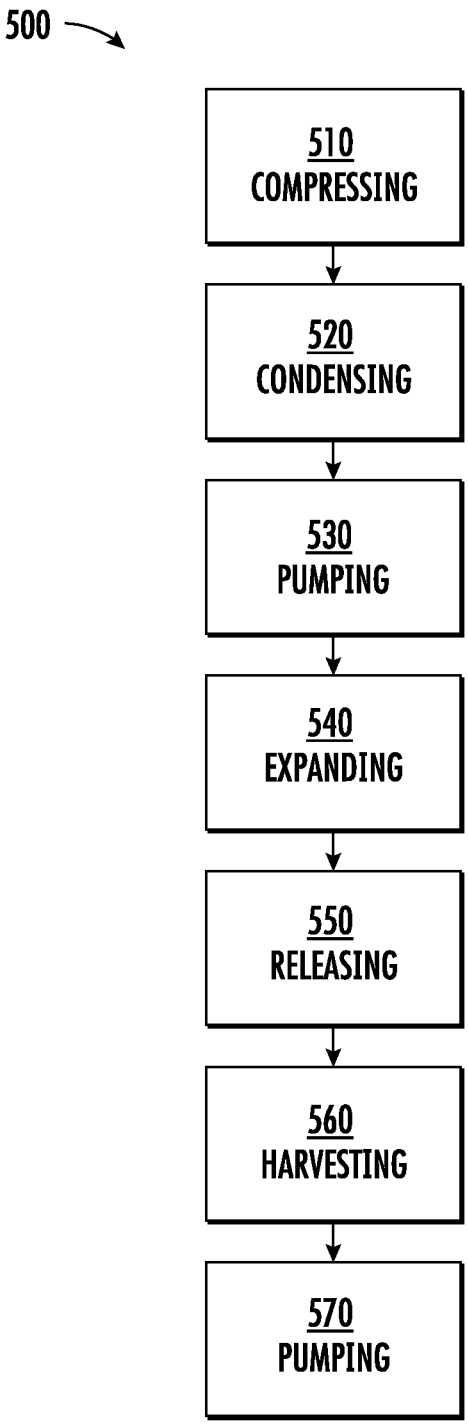
FIG. 5 is a plot demonstrating the effects of the method of operating the example ice making appliance of FIG. 1 compared to the traditional operation.

As shown in FIG. 5, a method 500 of operating an ice making appliance where the ice making appliance includes one of a low back-pressure compressor and a medium back-pressure compressor. At 510, compressor 132, e.g., one of the low back-pressure compressor or the medium back-pressure compressor, compresses a refrigerant. At 520, condenser 134 condenses the refrigerant into liquid. At 530, pump 154 pumps water from a water supply 152 to ice maker 200. At 540, cooling, through evaporator 138, the liquified refrigerant expanding into gaseous refrigerant where the expansion of refrigerant draws heat energy from the surroundings, e.g., an ice mold (not shown) of ice maker 200. Evaporator 138 may be proximate ice maker 200 such that the water on ice maker 200 freezes into ice. At 550, compressor 132 may be turned off, thus releasing hot refrigerant gas, via convection currents through bypass valve 144, to evaporator 138. By turning compressor 132 off at 550, the back-pressure of the refrigerant may not attain high back-pressure back to compressor 132, thus removing the need for a high back-pressure compressor. At 560, harvesting ice from ice maker 200. At 570, pump 154 pumps water from water supply 152 to evaporator 138 in order to cool evaporator 138 before reactivating compressor 132. Using the water from water supply 152 to cool evaporator 138 may then reduce the load experienced by compressor 132 when reactivated.

Figure 6:
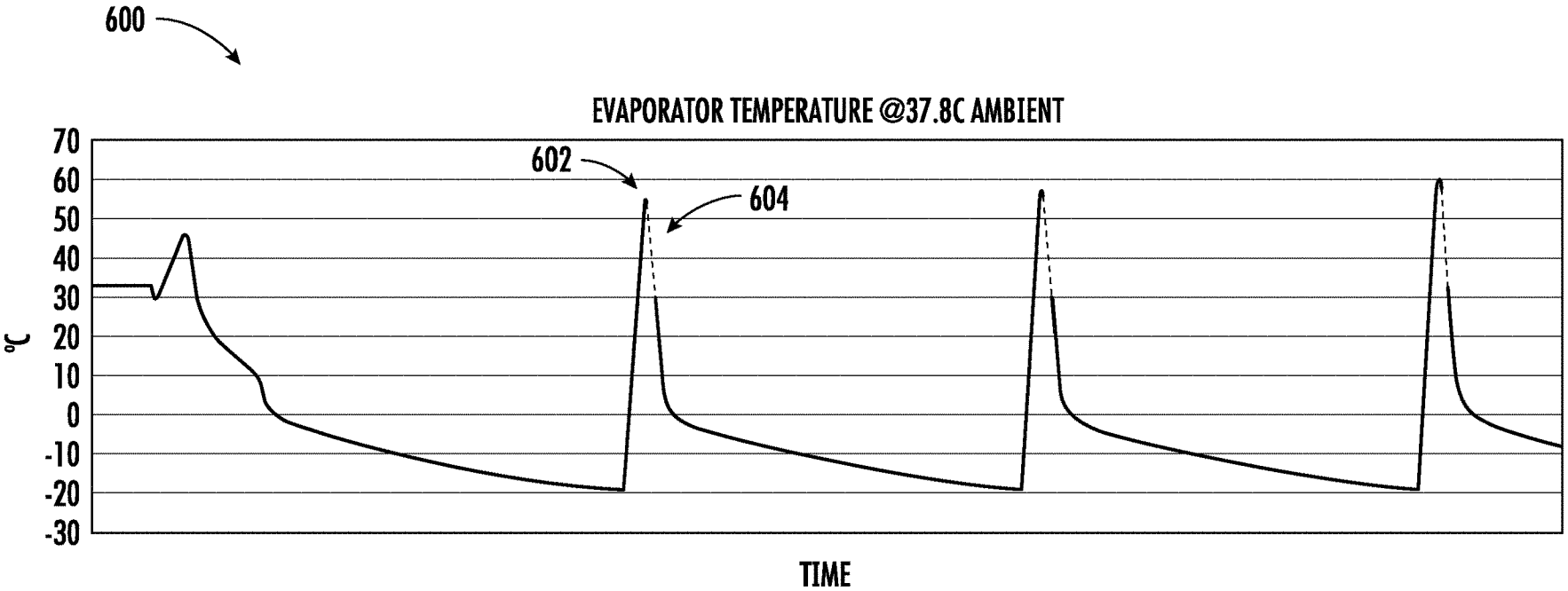
FIG. 6 is a plot demonstrating effects of the method of operating the example ice making appliance of FIG. 1.

Shown in FIG. 6, plot 600 provides a comparison of the traditional operation of refrigeration system 130 and the operation of refrigeration system 130 following method 500. The temperature of evaporator 138 reaches peak 602 at the pinnacle of the harvesting period. Traditionally, compressor 132 runs during a pulldown period 604 where the temperature of evaporator 138 is pulled back down to low temperatures, i.e., temperatures below freezing. Operating compressor 132 during the pulldown period sends high back-pressure to compressor 132, thus requiring a high back-pressure compressor. In accordance with aspects of method 500, turning compressor 132 off during the pulldown period 604 may not build back-pressure like in the traditional operating, thus permitting the use of a low or medium back-pressure compressor.

Figure 7:
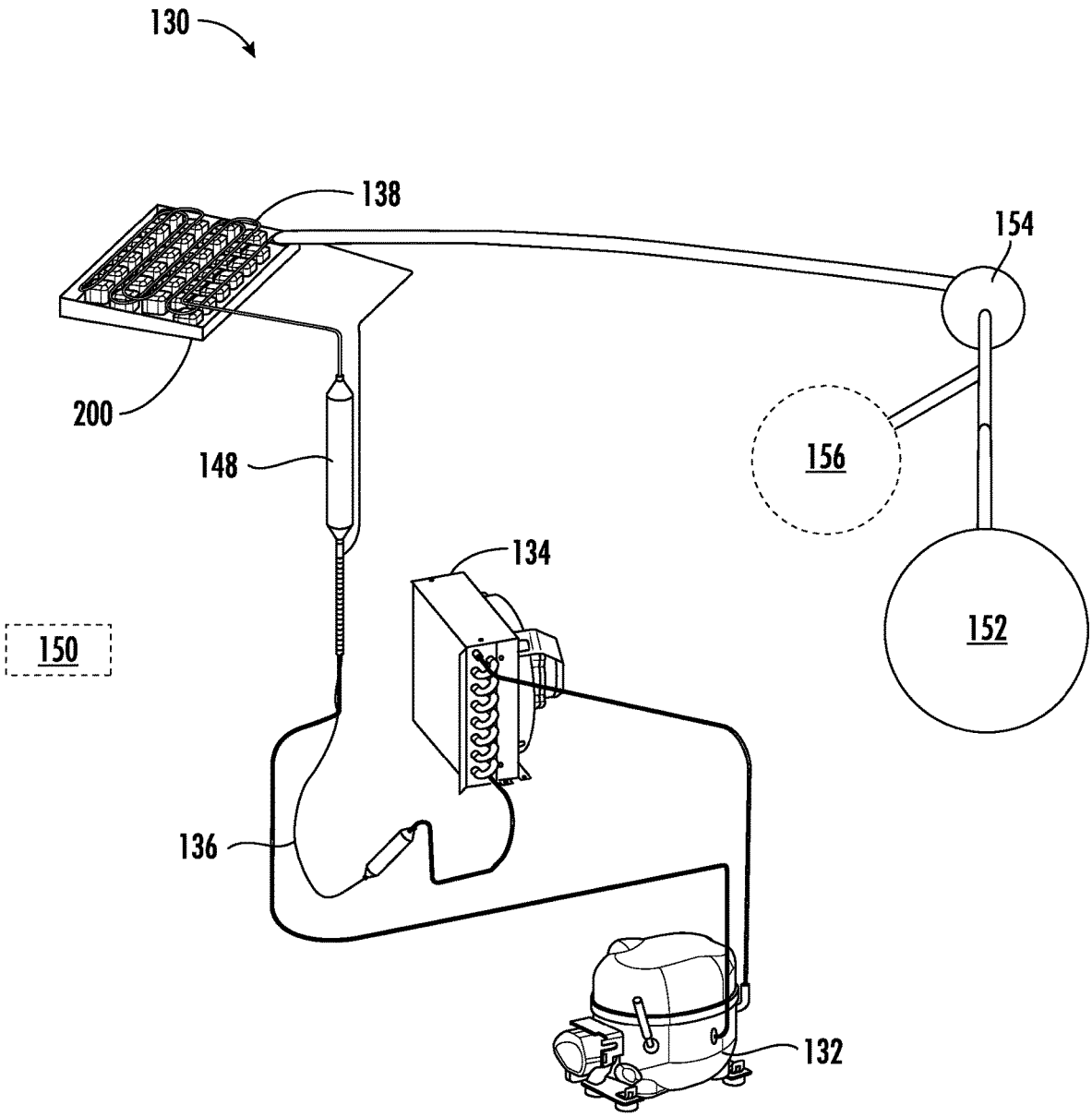
FIG. 7 is a schematic of an alternative example embodiment of a refrigeration system of the example ice making appliance of FIG. 1.

Shown in FIG. 7, sealed refrigeration system 700 may also be used in accordance with method 500. Sealed system 700 uses components in similarity with sealed system 130, with exception of bypass valve 144 and bypass conduit 146. In order to heat evaporator 138 during the harvesting period, hot water from water supply 152 is pumped, by pump 154, over evaporator 138. Cool water from reservoir 156 is then pumped, by pump 154, over evaporator 138 during the pulldown period. Using the water from reservoir 156 to cool evaporator 138 may then reduce the load experienced by compressor 132 when reactivated.

Figure 8:
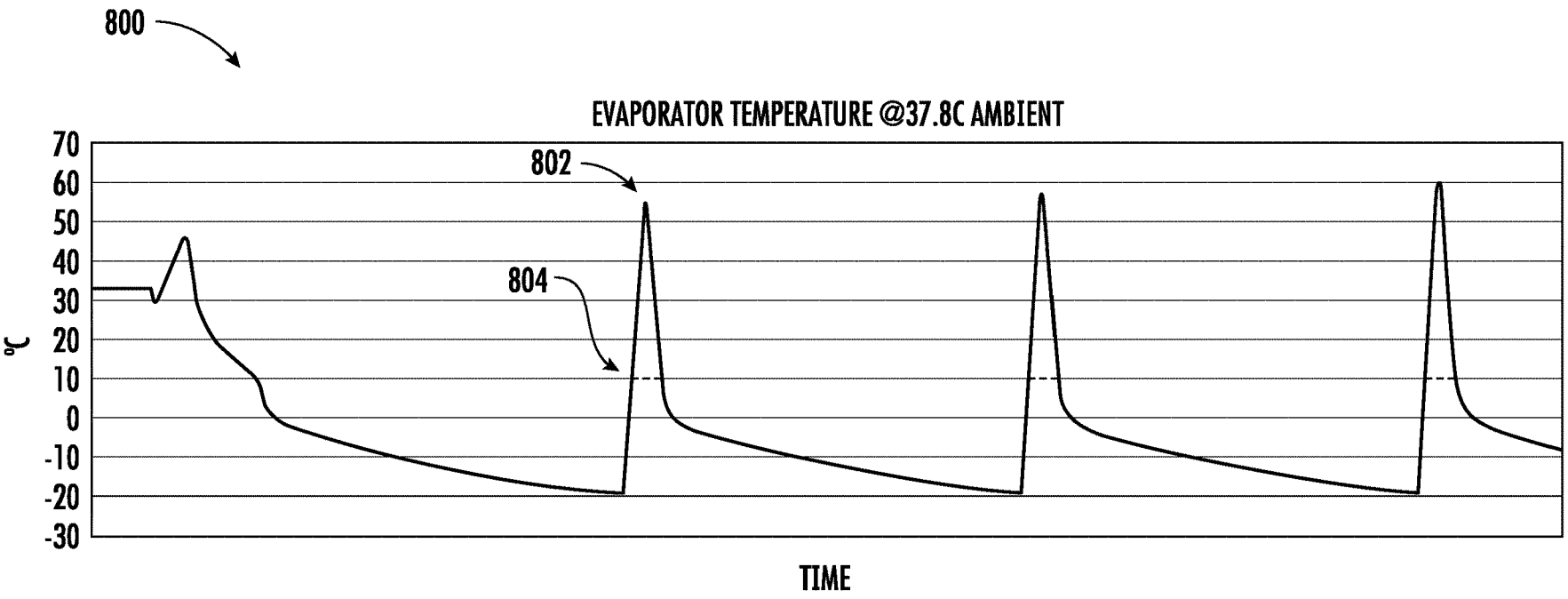
FIG. 8 is a plot demonstrating effects of the method of operating the example ice making appliance of FIG. 7.

Shown in FIG. 8, plot 800 provides a comparison of the operation of refrigeration system 700, as if run traditionally, and the operation of refrigeration system 700 following method 500. The temperature of evaporator 138 reaches peak 802 at the pinnacle of the harvesting period. Traditionally, compressor 132 runs during the pulldown period where the temperature of evaporator 138 is pulled back down to low temperatures, i.e., temperatures below freezing. Operating compressor 132 during the pulldown period sends high back-pressure to compressor 132, thus requiring a high back-pressure compressor. In accordance with aspects of method 500, turning compressor 132 off during the pulldown period may not build back-pressure like in the traditional operating compressor. Thus turning off compressor 132 across portion 804 permits the use of a low or medium back-pressure compressor.

FIG. 5 depict steps performed in a particular order for purposes of illustration and discussion. Those of ordinary skill in the art, using the disclosures provided herein, will understand that the steps of any of the methods discussed herein may be adapted, rearranged, expanded, omitted, or modified in various ways without deviating from the scope of the present disclosure. Moreover, although aspects of method 500 is explained using ice making appliance 100 as an example, it should be appreciated that these methods may be applied to the operation of any suitable appliance.

As may be seen from the above, when harvesting ice from ice maker 200, hot refrigerant may be sent through bypass valve 144 directly from compressor 132 discharge to evaporator 138. During the harvest period, evaporator 138 is at a very high back-pressure, however the high-side pressure may be almost equal to the low-side pressure, so compressor 132 is doing little work. The heat stored in compressor 132 may be transferred to evaporator 138. After the harvest period the bypass valve 144 may close, and the high evaporator 138 temperature may correspond to a high pressure of the refrigerant. If compressor 132 is turned off directly after harvest, evaporator 138 may be cooled down by the water from reservoir 156. Once evaporator 138 is cooled, compressor 132 may be started and operated at a medium back-pressure and then a low back-pressure as ice is formed. A further reduction in compressor load may be accomplished by turning pump 154 off for some time when compressor 132 is reactivated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making appliance, comprising:
an ice mold; and
a refrigeration system comprising,
a pump in fluid connection with a water supply,
a compressor in fluid communication with a bypass valve, the compressor being one of a low back-pressure compressor and a medium back-pressure compressor, and
a condenser and an evaporator in fluid communication with the bypass valve, the evaporator positioned proximate the ice mold, the pump operable to flow liquid from the water supply over the evaporator,
wherein the compressor is configured to turn off during an ice harvesting period, after the ice harvesting period, or both, and
wherein, during a pulldown period and before reactivating the compressor, the pump flows liquid from a reservoir of the water supply over the evaporator, the pulldown period occurring after the ice harvesting period.

2. The ice making appliance of claim 1, wherein the ice making appliance is one of a freestanding appliance and a built-in appliance.

3. The ice making appliance of claim 1, wherein the compressor is operable to flow refrigerant to the evaporator while in the ice harvesting period.

4. The ice making appliance of claim 1, wherein the reservoir is positioned proximate the ice mold.

5. The ice making appliance of claim 1, wherein the compressor is configured to turn off during the pulldown period while the pump flows liquid over the evaporator.

6. The ice making appliance of claim 5, wherein the compressor is configured to turn on after the pulldown period.

7. An ice making appliance, comprising:
an ice mold; and
a refrigeration system comprising,
a pump in fluid connection with a water reservoir,
a compressor, the compressor being one of a low back-pressure compressor and a medium back-pressure compressor,
a condenser and an evaporator, the evaporator positioned proximate the ice mold,
wherein the compressor is configured to turn off during an ice harvesting period,
wherein the pump is configured to pump water from the water reservoir over the evaporator during the ice harvesting period,
wherein the compressor is configured to reactivate after a pulldown period, and
wherein during the pulldown period, before reactivating the compressor, the pump flows liquid from the water reservoir over the evaporator, the pulldown period occurring after the ice harvesting period.

8. The ice making appliance of claim 7, wherein the ice making appliance is one of a freestanding appliance and a built-in appliance.

9. The ice making appliance of claim 7, wherein the compressor is operable to flow refrigerant to the evaporator while in the ice harvesting period.

10. The ice making appliance of claim 7, wherein the water reservoir is positioned proximate the ice mold.

11. The ice making appliance of claim 7, wherein the compressor is configured to turn off during the pulldown period while the pump flows liquid over the evaporator.

12. The ice making appliance of claim 11, wherein the compressor is configured to turn on after the pulldown period.

13. A method of operation an ice making appliance, the ice making appliance comprising one of a low back-pressure compressor and a medium back-pressure compressor, an ice mold, and a pump in fluid connection with a water supply, the method comprising:
compressing, with the one of the low back-pressure compressor or the medium back-pressure compressor, a refrigerant;
condensing, by a condenser, the refrigerant;
heating, by an evaporator, the refrigerant, the evaporator positioned proximate the ice mold such that the refrigerant draws heat from water in the ice mold;
pumping, by the pump, water from the water supply over the evaporator during an ice harvesting period;
releasing, from the one of the low back-pressure compressor or the medium back-pressure compressor, hot refrigerant through a bypass valve to the evaporator during the ice harvesting period, the one of the low back-pressure compressor or the medium back-pressure compressor being off during the ice harvesting period when the hot refrigerant is released;
harvesting, from the ice mold, ice during the ice harvesting period,
pumping, by the pump, water from the water supply over the evaporator during a pulldown period, the pulldown period occurring after the ice harvesting period, and reactivating the one of the low back-pressure compressor or the medium back-pressure compressor after the pulldown period.

14. The method of claim 13, wherein the ice making appliance is one of a freestanding appliance and a built-in appliance.

15. The method of claim 13, further comprising flowing, by the one of the low back-pressure compressor or the medium back-pressure compressor, refrigerant to the evaporator while in the ice harvesting period.

16. The method of claim 13, wherein pumping water from the water supply comprises pumping water from a reservoir of the water supply over the evaporator in order to cool the evaporator, the reservoir is positioned proximate the ice mold.

17. The method of claim 16, further comprising deactivating the compressor during the pulldown period while pumping water over the evaporator.

* * * * *